US009670654B2

(12) United States Patent
Sansum et al.

(10) Patent No.: US 9,670,654 B2
(45) Date of Patent: Jun. 6, 2017

(54) FLUID DELIVERY DEVICE

(71) Applicant: Kohler Mira Limited, Gloucestershire (GB)

(72) Inventors: Nigel P. Sansum, Quedgeley (GB); Paul A. Gostling, Abbeymead (GB)

(73) Assignee: KOHLER MIRA LIMITED (GB)

( * ) Notice: Subject to any disclaimer, the term of this patent is extended or adjusted under 35 U.S.C. 154(b) by 0 days.

(21) Appl. No.: 15/004,477

(22) Filed: Jan. 22, 2016

(65) Prior Publication Data

US 2016/0138252 A1 May 19, 2016

Related U.S. Application Data

(63) Continuation of application No. 13/881,277, filed as application No. PCT/GB2011/052084 on Oct. 26, 2011, now Pat. No. 9,243,388.

(30) Foreign Application Priority Data

Oct. 26, 2010 (GB) ..... 1018074.3

(51) Int. Cl.
*E03C 1/042* (2006.01)
*E03C 1/04* (2006.01)

(52) U.S. Cl.
CPC ..... *E03C 1/0402* (2013.01); *E03C 1/04* (2013.01); *E03C 1/0401* (2013.01); (Continued)

(58) Field of Classification Search
CPC ..... E03C 1/04; E03C 1/0402; E03C 1/0401
(Continued)

(56) References Cited

U.S. PATENT DOCUMENTS 5,465,749 A 11/1995 Sauter
6,328,059 B1 12/2001 Testori
6,484,330 B2 11/2002 Gray et al.

FOREIGN PATENT DOCUMENTS

CN 1118619 3/1996
CN 2420472 2/2001
(Continued)

OTHER PUBLICATIONS

International Search Report mailed Jan. 25, 2012 regarding Application No. PCT/GB2011/052084.
(Continued)

*Primary Examiner* — Huyen Le
*Assistant Examiner* — Christine Skubinna
(74) *Attorney, Agent, or Firm* — Foley & Lardner LLP

(57) ABSTRACT

Apparatus and method for attaching a tap to a mounting surface (13) has a clamping assembly inserted through an aperture (11) in the mounting surface (13) and tightened from above the mounting surface (13). The clamping assembly has a pair of clamping arms (25, 27) that are mounted for pivotal movement from a collapsed position for passage through the aperture (11) to an operative position below the mounting surface (11). The clamping arms (25, 27) are operable on tightening the clamping assembly to engage in a first stage an underside of the mounting surface (13) remote from the fluid delivery device and to engage in a second stage a sidewall of the aperture (11) when continuing tightening. Thus a step change in an operating force is required that provides feedback to an installer that a required clamping force has been achieved.

18 Claims, 7 Drawing Sheets

(52) U.S. Cl.
CPC . *E03C 2001/0416* (2013.01); *Y10T 137/0402* (2015.04); *Y10T 137/6014* (2015.04)

(58) Field of Classification Search
USPC ..... 4/695
See application file for complete search history.

(56) References Cited

FOREIGN PATENT DOCUMENTS

| | | |
|---|---|---|
| EP | 0866180 | 9/1998 |
| FR | 2525296 | 10/1983 |
| WO | WO03/066977 | 8/2003 |

OTHER PUBLICATIONS

First Office Action Documents regarding Chinese Application No. 201410521163.4 (6 pages).
Notice of Allowance Documents regarding Chinese Application No. 201410521163.4 (5 pages).

FLUID DELIVERY DEVICE

CROSS-REFERENCE TO RELATED APPLICATIONS

This application is a continuation of U.S. application Ser. No. 13/881,277 filed Apr. 24, 2013, which is a U.S. National Phase application of International Application No. PCT/GB2011/052084 filed Oct. 26, 2011, which claims the benefit of and priority to UK Patent Application No. 1018074.3 filed Oct. 26, 2010. The entire disclosures of U.S. application Ser. No. 13/881,277, International Application No. PCT/GB2011/052084, and UK Patent Application No. 1018074.3 are incorporated by reference herein.

BACKGROUND

This invention concerns improvements in and relating to fluid delivery devices including but not limited to taps. More especially the invention concerns a system and method for the installation of taps that allows the installation to be carried out from above a mounting surface on, for example a sink, washbasin, bidet, bath or the like.

When installing a tap, the incoming hot and cold water supplies must be isolated either centrally by closing off a stop-cock for the incoming water supply to the property or by closing isolating valves fitted either locally to a specific tap or to a group of taps. The tap is located on the mounting surface and an externally threaded shank extends through an opening in the mounting surface onto which a nut and washer is screwed to engage the underside of the mounting surface to locate and retain the tap in position. This is usually achieved by holding the tap in the correct orientation in one hand above the mounting surface and manually screwing the nut and washer onto the shank with the other hand from below the mounting surface with the other hand. The nut can be tightened with a spanner from below the mounting surface to firmly secure the tap in position. A supply pipe is then screwed onto the shank from under the mounting surface to connect the tap to a supply of hot or cold water. Mixer taps require separate connections to supplies of hot and cold water.

A disadvantage of the above method is that access to the underside of the mounting surface is often restricted. As a result, it can be difficult both to tighten the nut and washer so that the tap is firmly secured in position and to connect the supply pipe(s) to the tap in a fluid tight manner during installation. Furthermore, it can be difficult to rectify any leakage that occurs from the connection(s) following installation.

The present invention has been made from a consideration of the foregoing and seeks to overcome or at least mitigate one or more of the aforementioned problems and disadvantages of the prior art.

SUMMARY

According to one aspect of the invention there is provided a fluid delivery device for connection to a fluid supply through an aperture in a mounting surface, and a clamping assembly for securing the fluid delivery device to the mounting surface, the clamping assembly including retainer means adapted, in use, to pass through the aperture in a collapsed position and to move to an operative position after passing through the aperture, the retainer means being operable on tightening the clamping assembly from above the mounting surface to engage an underside of the mounting surface remote from the fluid delivery device and to engage a sidewall of the aperture.

By this invention, the clamping assembly can be fitted from above the mounting surface so that access to the underside of the mounting surface may not be required. The engagement of the retainer means with the underside of the mounting surface and with the sidewall of the aperture provides feedback to the installer of the clamping force while the clamping assembly is tightened. For example, the retainer means may engage the sidewall of the aperture after engaging the underside of the mounting surface so as to produce a step change in the force required to tighten the clamping assembly that provides feedback to the installer that the necessary clamping force has been achieved. In this way, the risk of overtightening the clamping assembly and causing damage to the mounting surface may be reduced.

In one preferred embodiment, the retainer means includes a pair of clamping arms. In other embodiments, the retainer means may comprise more than two clamping arms. The number and arrangement of clamping arms may be chosen according to requirements, for example the available space for installation, the type of fluid delivery device and fluid connections. The clamping arms may be disposed symmetrically with respect to the aperture so that the clamping force is distributed uniformly and evenly around the aperture.

Preferably, each clamping arm is connected to a clamping plate so as to pass through the aperture with the clamping plate from the topside of the mounting surface.

In one arrangement, each clamping arm is connected to the clamping plate for pivotal movement from the collapsed position to the operative position. In another arrangement, at least one clamping arm is fixed to the clamping plate in the operative position and at least one clamping arm is connected to the clamping plate for pivotal movement from the collapsed position to the operative position. Each pivotal clamping arm may move to the operative position under gravity. Alternatively or additionally a spring or other biasing member may be employed. In this way, each pivotal clamping arm automatically adopts the operative position after passing through the aperture.

Preferably, fastening means is provided to move the clamping plate towards the underside of the mounting surface to engage each clamping arm with the underside of the mounting surface.

Preferably, the fastening means includes an actuator such as a bolt threadably coupled to the clamping plate such that the clamping plate can move lengthwise of the bolt in response to rotation of the bolt. For example, the clamping plate may be prevented from rotating relative to the threadably coupled bolt so as to move towards the underside of the mounting surface as the bolt is rotated in one direction and to move away from the mounting surface as the bolt is rotated in the opposite direction.

Preferably, the bolt extends through the aperture and is rotatable to operate the retainer means from the topside of the mounting surface.

Preferably, each clamping arm is configured to provide feedback to the installer of the clamping force while the bolt is rotated. For example, each clamping arm may have a first portion that is engageable with the underside of the mounting surface and a second portion that is engageable with the sidewall of the aperture. The second portion may engage after the first portion so as to produce a step change in the force required to rotate the bolt that provides feedback to the installer that the necessary clamping force has been achieved. In this way, the risk of overtightening the clamping assembly and causing damage to the article providing the mounting surface, for example a basin or bath or sink, is reduced.

Preferably, at least one clamping arm, more preferably each clamping arm, is configured to grip the underside of the mounting surface and/or the sidewall of the aperture when the bolt is rotated so as to create locking forces that resist rotation of the clamping assembly. For example, one or more clamping arms may be provided with formations such as serrations or knurling that contact and grip the underside of the mounting surface and/or the sidewall of the aperture.

Alternatively or additionally, one or more clamping arms may be provided with a high friction material such as rubber, abrasive paper such as emery paper or other suitable elastomeric or polymeric material that contacts and grips the underside of the mounting surface and/or the sidewall of the aperture. The high friction material may be overmoulded on the clamping arm(s). The formations and/or high friction material can help to secure the fluid delivery device in a desired position and prevent the fluid delivery device rotating after installation. This may be of particular benefit where the mounting surface for the fluid delivery device is a ceramic or glass surface.

Preferably, the fluid delivery device includes a mounting element connectable to the fluid supply and a body element detachably connected to the mounting element.

Preferably, the mounting element is coupled to the clamping plate by the fastening means and is secured to the mounting surface when the fastening means is actuated to cause the clamping arms to engage the underside of the mounting surface as described previously.

Preferably, a more secure fixing of the fluid delivery device is provided by preventing or inhibiting relative rotation between the body element and each clamping arm. In one arrangement, relative rotation is prevented by each clamping arm co-operating with the mounting element. In another arrangement, relative rotation is prevented by each clamping arm co-operating with the body element. In either arrangement each clamping arm is preferably guided for axial movement relative to the mounting element or body element and is constrained from rotating relative to the mounting element or body element. For example, each clamping arm may be received in an axial keyway that allows the clamping arm to slide up and down without rotating.

The body element may comprise flow control means such as a tap or mixer housing a mechanism for controlling flow of water. The mounting element may comprise a fluid manifold base that is substantially concealed by the body element.

Preferably, the manifold base has an inlet connectable to the fluid supply and an outlet connectable to the body element.

Preferably, the mounting element includes an isolator valve assembly to isolate the fluid supply when the body element is detached from the mounting element.

Preferably, the isolator valve assembly is operable in response to attaching and detaching the body element.

Preferably, the body element is releasably attached to the mounting element by interengageable formations.

Preferably, the interengageable formations are engaged and disengaged by axial and rotational movement of the body element relative to the mounting element.

Preferably, the interengageable formations comprise a bayonet type connection.

Preferably the isolator valve assembly has an open position to connect the fluid supply to the body element when the body element is mounted on the mounting element and a closed position to isolate the fluid supply when the body element is removed from the mounting element.

Preferably, the isolator valve assembly moves between the open and closed positions in response to rotational movement of the body element relative to the mounting element.

Alternatively, the isolator valve assembly moves between the open and closed positions in response to axial movement of the body element relative to the mounting element.

According to another aspect of the invention there is provided a method of attaching a fluid delivery device to a mounting surface having a topside and an underside, the method comprising the steps of connecting the fluid delivery device to a water supply through an aperture in the mounting surface, providing a clamping assembly for securing the fluid delivery device to the mounting surface, positioning the fluid delivery surface on the topside of the mounting surface and passing retainer means of the clamping assembly through the aperture in a collapsed position to position the retainer means below the mounting surface whereupon the retainer means moves to an operative position, and operating the clamping assembly from the topside of the mounting surface to engage the retainer means with the underside of the mounting surface and with a sidewall of the aperture to secure and retain the fluid delivery device on the topside of the mounting surface.

Preferably, the clamping assembly is operable by rotating an actuator that extends through the aperture in the mounting surface.

Preferably, rotation of the actuator in one direction fastens the clamping assembly and rotation in the opposite direction unfastens the clamping assembly.

Preferably, the retainer means includes two or more clamping arms connected to a clamping plate and at least one clamping arm, more preferably each clamping arm, is pivotal between the collapsed position and the operative position for passage of the retainer means through the aperture in the collapsed position.

Preferably, the actuator comprises a rotatable member such as a bolt that threadably engages the clamping plate.

With this arrangement, each pivotal clamping arm can move to the operative position after passing through the aperture, for example under gravity or the action of a biasing member such as a spring, and the clamping plate is movable lengthwise of the rotatable member in response to rotation thereof to move the clamping arms towards the underside of the mounting surface.

Preferably, the clamping arms engage the underside of the mounting surface in a first stage of operation and engage the sidewall of the aperture in a second stage of operation. The sidewall acts as stop to limit movement of the clamping arms and results in an increase in force required to rotate the rotatable member that provides feedback to the installer of the required clamping force to prevent overtightening of the clamping assembly.

Preferably, at least one clamping arm, more preferably each clamping arm, is adapted to resist relative rotation between the clamping arm and the mounting surface. For example, the or each clamping arm may be provided with formations such as serrations or knurling and/or with a high friction material such as rubber to enhance the grip when tightening the clamping assembly.

According to another aspect of the invention there is provided apparatus for connecting a fluid supply to a fluid delivery device, the apparatus including a connector for connection to a fluid supply and a clamping assembly for securing the connector to a mounting surface, the clamping assembly including retainer means adapted, in use, to pass through an aperture in the mounting surface in a collapsed position and to move to an operative position after passing through the aperture, the retainer means being operable on tightening the clamping assembly from above the mounting surface to engage an underside of the mounting surface remote from the connector and to engage a sidewall of the aperture to secure the connector to the mounting surface.

The connector may be connectable to individual supplies of hot and/or cold water and/or to a combined supply of hot and cold water. The connector is preferably secured on the upper surface or top side of the mounting surface and is adapted for attaching a fluid delivery device such as a tap or mixer.

The clamping assembly may be as described in connection with the previous aspects of the invention.

According to a further aspect of the invention there is provided a fluid delivery device for connection to a fluid supply through an aperture in a mounting surface, and a clamping assembly for securing the fluid delivery device to the mounting surface, the clamping assembly being adapted, in use, to pass through the aperture in a collapsed position and to move to an operative position after passing through the aperture for engagement with an underside of the mounting surface remote from the fluid delivery device.

Preferably, the clamping assembly is arranged to produce a step change in an operating force required to tighten the clamping assembly that provides feedback to an installer that a required clamping force has been achieved. In this way, the risk of overtightening the clamping assembly and causing damage to the article providing the mounting surface, for example a basin or bath or sink, is reduced.

The clamping assembly may be as described in connection with previous aspects of the invention. The clamping assembly may move to the operative position under gravity.

According to another aspect of the invention there is provided a method of attaching a fluid delivery device to a mounting surface having a topside and an underside, the method comprising the steps of connecting the fluid delivery device to a water supply through an aperture in the mounting surface, providing a clamping assembly for securing the fluid delivery device to the mounting surface, positioning the fluid delivery surface on the topside of the mounting surface and passing the clamping assembly through the aperture in a collapsed position to position the clamping assembly below the mounting surface whereupon the clamping assembly moves to an operative position, and operating the clamping assembly from the topside of the mounting surface to engage the underside of the mounting surface to secure and retain the fluid delivery device on the topside of the mounting surface.

Preferably, the clamping assembly is arranged to produce a step change in an operating force required to tighten the clamping assembly that provides feedback to an installer that a required clamping force has been achieved. In this way, the risk of overtightening the clamping assembly and causing damage to the article providing the mounting surface, for example a basin or bath or sink, is reduced.

The clamping assembly employed may be as described in connection with previous aspects of the invention. The clamping assembly may move to the operative position under gravity.

According to another aspect of the invention there is provided a fluid delivery device comprising a mounting element for connection to a fluid supply and body element mounted on the mounting element for controlling discharge of fluid from the device, the body element being detachable from the mounting element without disconnecting the mounting element from the fluid supply, and the mounting element including an isolator valve assembly having an open position to connect the fluid supply to the body element when the body element is mounted on the mounting element and a closed position to isolate the fluid supply when the body element is removed from the mounting element, wherein the isolator valve assembly moves between the open and closed positions as the body element is attached to and detached from the mounting element.

Preferably, the body element is a push fit on the mounting element and is secured by rotating the body element relative to the mounting element.

Preferably, the body element is rotatable between a release position that allows the body element to be pushed on and lifted off the mounting element and a retained position that prevents the body element being lifted off the mounting element.

Preferably, the isolator valve assembly is opened and closed according to the direction of rotation of the body element at a position between the release position and retained position.

BRIEF DESCRIPTION OF THE DRAWINGS

The invention will now be described in more detail by way of example only with reference to the accompanying drawings wherein.

DETAILED DESCRIPTION

Figure 1:
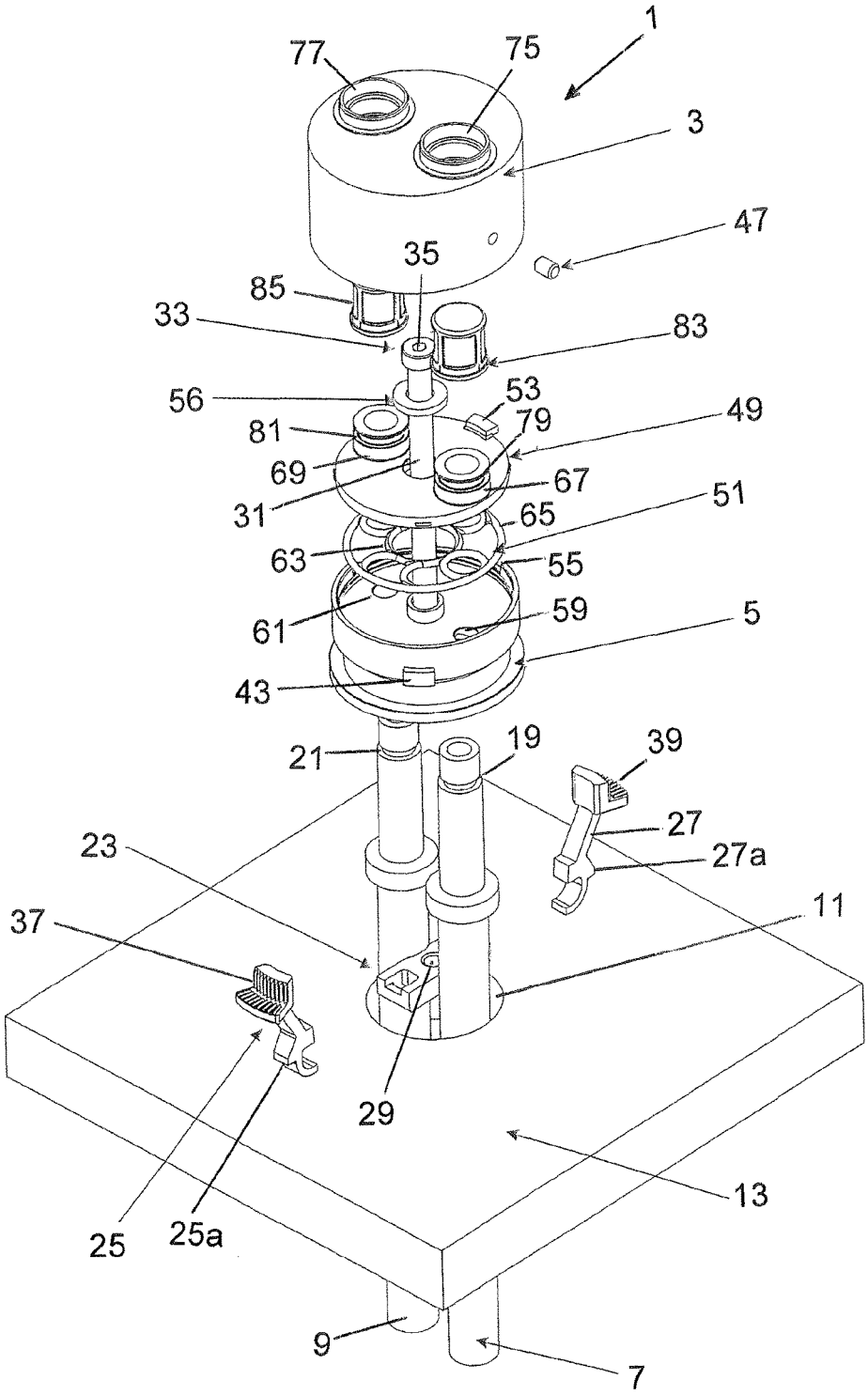
FIG. 1 is an exploded view of a tap assembly according to a first embodiment of the invention.
Figure 2:
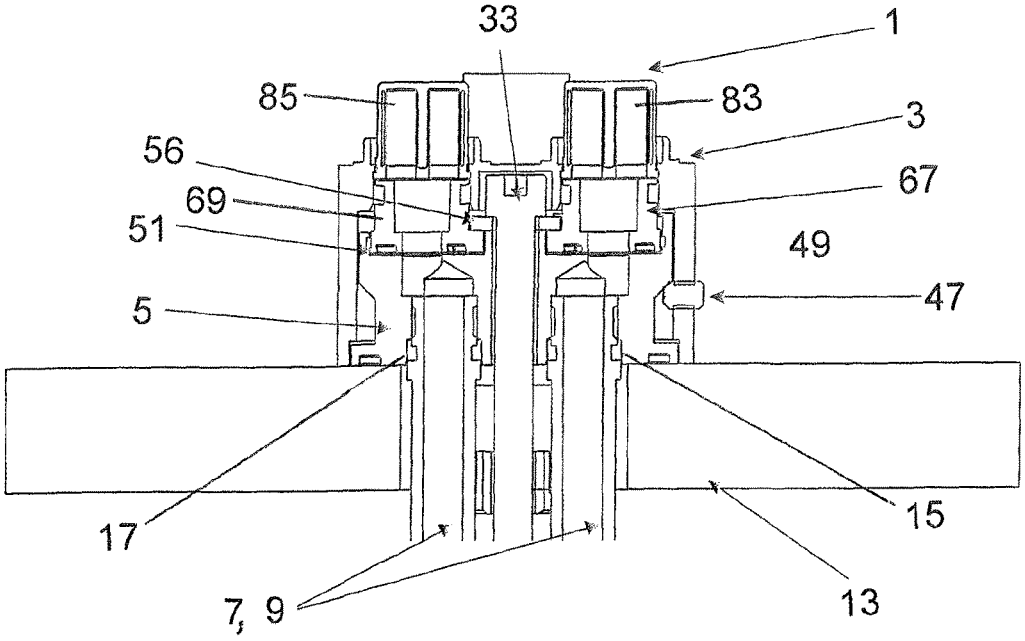
FIG. 2 is a vertical section showing the manifold base and tap body in the normal operating position.

Referring to FIGS. 1 to 9 of the drawings, a tap assembly 1 has a body element 3 detachably connected to a mounting element 5 connected to a pair of supply pipes 7, 9 for hot and cold water. In this embodiment the body element 3 is a tap body provided with a flow control and/or mixing mechanism for the hot and cold water and the mounting element 5 is a fluid manifold base for delivering hot and cold water from the supply pipes 7, 9 to the tap body.

The supply pipes 7, 9 extend through an aperture 11 in a mounting surface 13 and engage inlets 15, 17 in the underside of the manifold base 5. The supply pipes 7, 9 and inlets 15, 17 may have mating screw threads to secure releasably the supply pipes 7, 9 to the manifold base 5. The supply pipes 7, 9 may be provided with seals such as O-rings (not shown) mounted in grooves 19, 21 co-operable with the inlets 15, 17 to provide a watertight seal. Any other means of securing and sealing the supply pipes 7, 9 may be employed. The mounting surface 13 may be a sink, wash-basin, bidet, bath or any other suitable surface for mounting the tap assembly, for example a worktop. The mounting surface 13 may comprise a ceramic, glass, wood (including wood substitutes or composites) or any other suitable material for mounting the tap assembly 1.

The manifold base 5 is seated on the topside of the mounting surface 13 and is releasably secured to the mounting surface 13 by a clamping assembly including retainer means for passage through the aperture 11 from the topside of the mounting surface 13 and operable on tightening the clamping assembly from the topside of the mounting assembly to secure the manifold base 5 to the mounting surface. As shown, the retainer means includes a clamping plate 23 and a pair of clamping arms 25, 27. The clamping plate 23 is located between the supply pipes 7, 9 and the clamping arms 25, 27 are pivotally connected to opposite ends of the clamping plate 23. The clamping plate 23 has a central aperture 29 provided with a screw thread (not shown) that is engaged by a screw thread (not shown) on the lower end of a bolt 31 that extends through the manifold base 5. The bolt 31 has a head 33 provided with a socket 35 for receiving a tool (not shown) to rotate the bolt 31.

Figure 8:
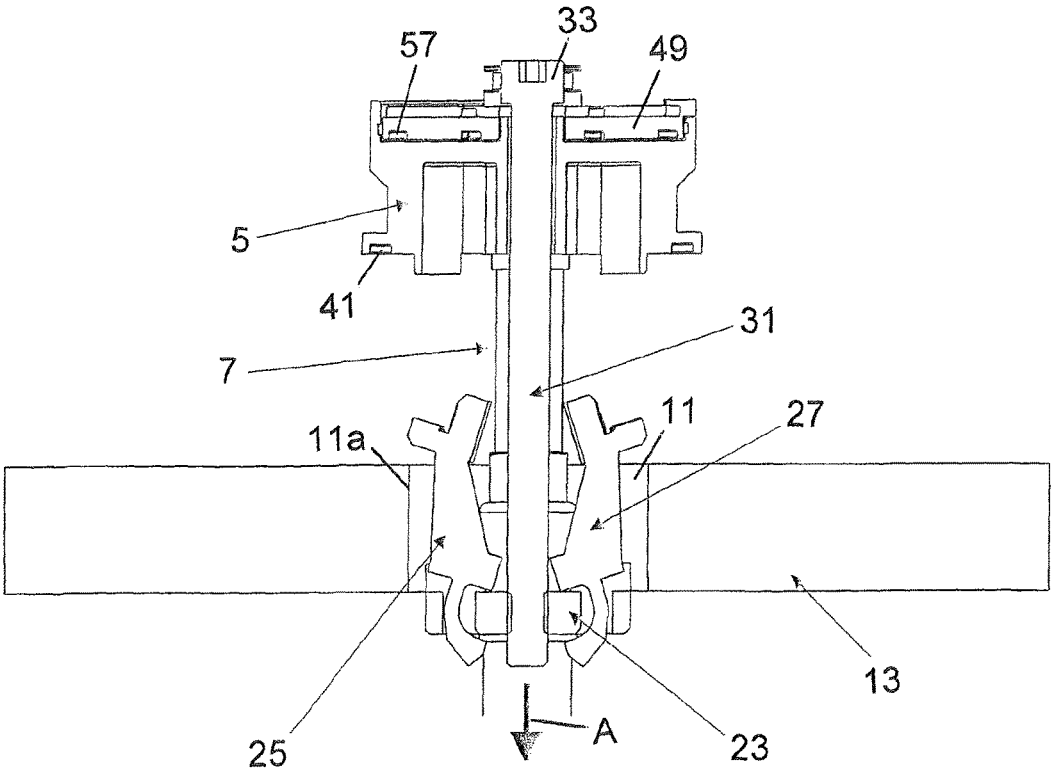
FIG. 8 is a vertical section showing installation of the manifold base.

To secure the manifold base 5 to the mounting surface 13, the supply pipes 7, 9 are attached to the inlets 15, 17 in the underside of the manifold base 5. The clamping arms 25, 27 are pivoted upwards to extend in the direction of the length of the bolt 31 to a closed or collapsed inoperative position in which the free ends of arms 25, 27 are adjacent the bolt 31 and the manifold base 5 is then lowered towards the mounting surface 13 to pass the clamping plate 23 and clamping arms 25, 27 through the aperture 11 in the mounting surface 13 in the direction of arrow A as shown in FIG. 8.

Figure 9:
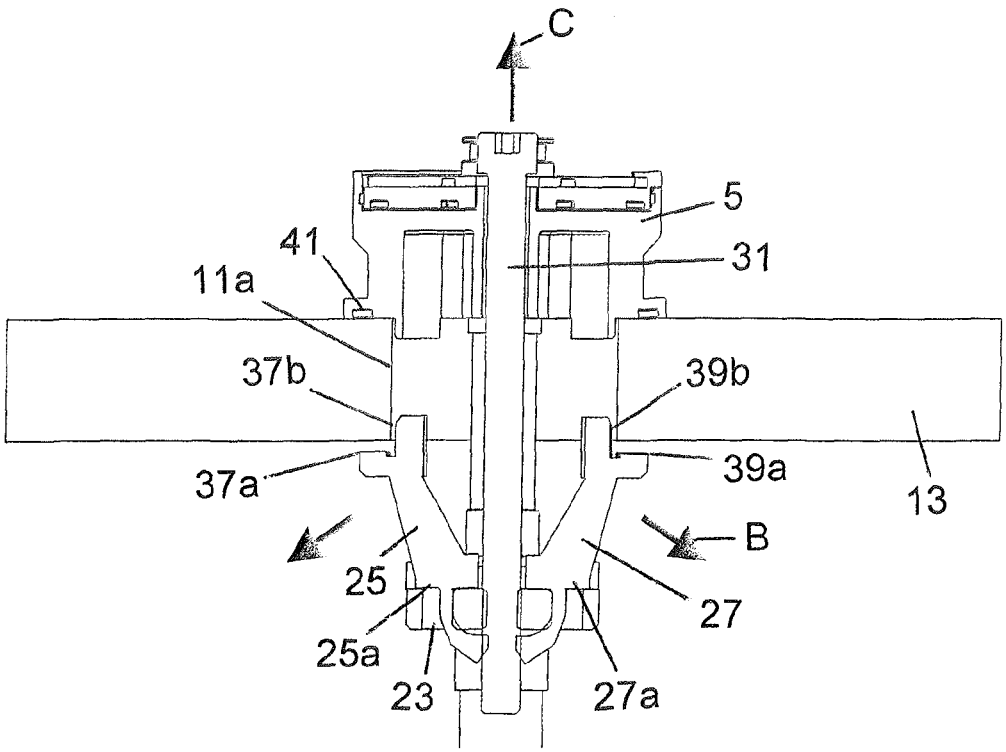
FIG. 9 is a vertical section showing the manifold base installed.

When the clamping arms 25, 27 clear the aperture 11 on the underside of the mounting surface, they pivot outwards under gravity in the direction of arrow B as shown in FIG. 9 to an open or extended operative position in which the free ends are spaced away from the bolt 31 and lugs 25*a*, 27*a* engage the mounting plate 23 to prevent further pivotal movement of the arms 25, 27. The clamping arms 25, 27 are preferably configured so as to pivot to the operative position automatically on clearing the aperture 11 on the underside of the mounting surface 13. For example, the shape and/or mass of the clamping arms 25, 27 may be arranged so that the clamping arms 25, 27 will adopt the operative position under gravity in the absence of a restraining force to retain the clamping arms 25, 27 in the inoperative position. In a modification (not shown) the clamping arms may be urged towards the operative position by a biasing member such as a spring and movable to the collapsed position against the biasing force for passage through the aperture.

The free ends of the clamping arms 25, 27 are provided with angle section formations 37, 39 having faces 37*a*, 37*b* and 39*a*, 39*b* that extend normal to one another. In the open position, the faces 37*a*, 39*a* extend generally parallel to the underside of the mounting surface and the faces 37*b*, 39*b* extend generally normal to the underside of the mounting surface. The underside of the manifold base 5 is stepped to locate within the aperture 11 in the mounting surface 13 and a seal such as an O-ring (not shown) may be mounted in a groove 41 in the underside of the manifold base 5 to provide a watertight seal between the manifold base 5 and the mounting surface 13 around the aperture 11.

The bolt 31 is then rotated to tighten the clamping assembly by inserting a tool (not shown) in the socket 35. As the bolt 31 is rotated, the clamping plate 23 is prevented from rotating by the water supply pipes 7, 9 with the result that the clamping plate 23 is lifted upwards in the direction of arrow C as shown in FIG. 9 towards the underside of the mounting surface 13 causing the clamping arms 25, 27 to rise upwards until the faces 37*a*, 39*a* contact the underside of the mounting surface at the edge of the aperture 11.

Further rotation of the bolt 31 to tighten the clamping assembly takes up any slack and a small sliding action of the clamping arms 25, 27 occurs radially until the faces 37*b*, 39*b* contact the inner sidewall 11*a* of the aperture 11 in the mounting surface 13. The contact between the faces 37*a*, 39*a* and the underside of the mounting surface 13 and between the faces 37*b*, 39*b* and the inner sidewall of the aperture produces friction to prevent rotation of the manifold base 5 relative to the mounting surface 13. Furthermore, contact between the faces 37*b*, 39*b* with the inner side wall 11*a* of the aperture 11 locks the arms 25, 27 and provides feedback to the user that the bolt 31 is sufficiently tight to secure the manifold base 5 in position. In this way, excessive tightening of the clamping assembly can be avoided. Controlling the clamping force may of particular benefit where the tap assembly 1 is secured to a surface that may be damaged by overtightening the clamping assembly, for example a ceramic or glass surface.

The grip to secure the manifold base 5 and resist relative rotation between the manifold base 5 and the mounting surface may be enhanced by appropriate design of the clamping arms 25, 27. For example, the contact faces 37*a*, 39*a* and/or the contact faces 37*b*, 39*b* may be formed or provided with a high friction material (not shown) to increase the grip. Where provided, the high friction material may be made of rubber or other suitable elastomeric or polymeric material or abrasive paper such as emery to increase friction. The high friction material may be over-moulded on the angle section formations 37, 39. Alternatively or additionally, where provided, the contact faces 37*a*, 39*a* and/or the contact faces 37*b*, 39*b* may be formed or provided with formations such as teeth, serrations or knurls (not shown) to increase the grip. The formations may be configured to penetrate the underside of the mounting surface 13 and/or the inner side wall of the aperture 11 to provide an interlock. The formations may be formed or provided in high friction material. Increasing the grip may be of particular benefit where the tap assembly 1 is secured to a ceramic or glass surface to prevent rotation of the tap assembly 1 after installation.

When the manifold base 5 is secured in position, the tap body 3 is lowered onto the manifold base 5 and secured by any suitable means. For example, a bayonet connection may be provided between the tap body 3 and manifold base 5 to secure releasably the tap body 3 to the manifold base 5 by a combination of axial and rotational movement of the tap body 3 relative to the manifold base 5.

In this embodiment, a bayonet connection is provided by interengageable formations such as a lug 43 on the manifold base 5 that co-operates with a groove 45 in the inner surface of the tap body 3. The groove 45 has a first section 45*a* that extends in the axial direction from the end face of the tap body 3 to a second section 45*b* that extends in the circumferential direction around the tap body 3.

When connecting the tap body 3 to the manifold base 5, the tap body 3 is positioned to align the first section 45*a* with the lug 43 so that the lug 43 enters the first section 45*a* as the tap body 3 is lowered onto the manifold base 5. The lug 43 and groove 45 are configured so that the lug 43 aligns with the second section 45*b* when the end face of the tap body 3 seats on the mounting surface 13 to cover and conceal the manifold base 5. The tap body 3 is then rotated so that the lug 43 enters the second section 45*b* to prevent the tap body 3 being lifted off the manifold base 5. In this embodiment, the tap body 3 can be rotated through approximately 90 degrees until the lug 43 engages the end of the groove 45. The groove 45 may be configured to provide any desired range of axial and/or rotational movement to engage the lug 43 to locate and retain the tap body 3 on the manifold base 5.

When securing the manifold base 5 to the mounting surface 13, the lug 43 is positioned so that, when attaching the tap body 3 to the mounting base 5, the tap body 5 can be rotated to engage the lug 43 in the second section 45*b* and locate the tap body 3 in the required position for discharge of water. The tap body 3 may be retained in the required position by frictional engagement between the tap body 3 and manifold base 5. Alternatively or additionally, the tap body 3 may be locked in the required position by any suitable means, for example by tightening a grub screw 47 to engage a recess in the wall of manifold base 5. The grub 47 could be replaced with any other suitable fastening means such as a roll pin, a dowel, a standard headed screw or a more complex system such as a locking ring provided with a lug which fits into grooves in the manifold base and the tap body to prevent rotation where linear movement of the ring disengages one of the lugs and allows rotation of the tap body relative to the manifold assembly.

When the tap body 3 is secured to the manifold base 5, flow of hot water and cold water from the manifold base 5 to the tap body 3 is permitted and, when the tap body 3 is detached from the manifold base 5, flow of water is prevented by any suitable means. For example, an isolation valve assembly may be provided in the manifold base 5 that is opened when the tap body 3 is connected to the manifold base 5 and closed when the tap body 3 is disconnected from the manifold base 5. Alternatively, isolation valves may be provided in the supply pipes separate from the tap assembly to prevent fluid flow and allow the tap body 3 to be disconnected from the manifold base 5.

In this embodiment, an isolation valve assembly is provided by an isolator plate 49 and an isolator plate seal 51. The isolator plate 49 is mounted for rotation relative to the manifold base 5 between end positions defined by engagement of a lug 53 on the edge of the isolator plate 49 with opposite ends of a slot 55 in the sidewall of the manifold base 5. The isolator plate 49 is retained by the bolt 31 and a bearing washer 56 is mounted on the bolt 31 between the isolator plate 49 and the bolt head to allow relative rotation between the bolt 31 and the isolator plate 49. The isolator plate seal 51 seals between the underside of the isolator plate 49 and the manifold base 5 and is located in a channel 57 in the underside of the isolator plate 49 so as to rotate with the isolator plate 49. The configuration of the isolator plate seal could be changed depending on the sealing requirements. The isolator plate seal could be replaced with a pair of ceramic plates.

Inlet ports 59, 61 in the manifold base 5 connect the inlets 15, 17 to a region between inner and outer rings 63, 65 of the isolator plate seal 51 that prevent water leaking between the manifold base 5 and the isolator plate 49 at the inner and outer peripheries. The inner and outer rings 63, 65 are joined together by a plurality of connecting webs. The webs seal around two outlet ports 67, 69 in the isolator plate 49 and divide the region between the outlet ports 67, 69 into three areas 71*a,b,c* on one side of the ports and three areas 73*a,b,c* on the other side. The outlet ports 67, 69 extend above the isolator plate 49 and are received in a pair of inlet ports 75, 77 in the tap body 3 when the tap body 3 is lowered onto the manifold base 5 so that the isolator plate 49 rotates with the tap body 3. The outlet ports 67, 69 are provided with seals such as O-rings (not shown) received in annular grooves 79, 81 to provide a watertight seal with the inlet ports 75, 77 in the tap body 3. In this embodiment, the inlet ports 75, 77 in the tap body 3 are provided with removable filters 83, 85 that are retained in position by the outlet ports 67, 69 of the manifold base 5 when the tap body 3 is lowered onto the manifold base 5.

The isolator valve assembly controls the flow of water from the manifold base 5 to the tap body 3. When the tap body 3 is connected to the manifold base 5 in the normal operating position shown in FIGS. 2 and 5, the outlet ports 67, 69 of the isolator plate 49 are connected to the inlet ports 75, 77 in the tap body 3 and communicate with the inlet ports 59, 61 in the manifold base so that water can flow freely from the manifold base 5 to the tap body 3. The tap body 3 may be provided with a suitable mechanism (not shown) for discharge of hot water or cold water or a mixture of hot water and cold water.

Figure 3:
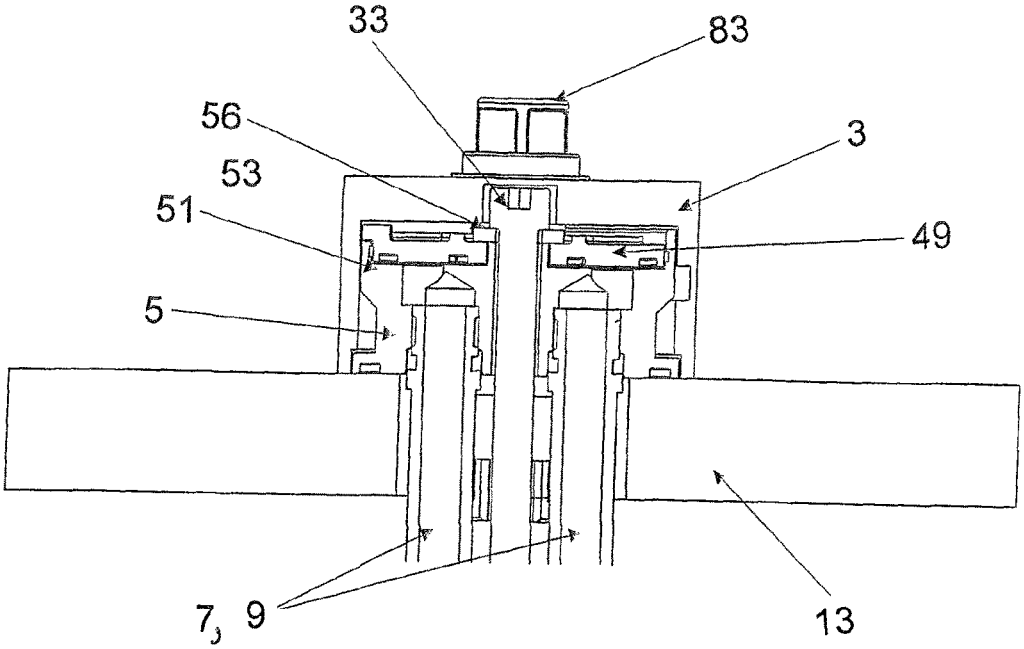
FIG. 3 is a vertical section showing the manifold base and tap body in the isolated position.
Figure 6:
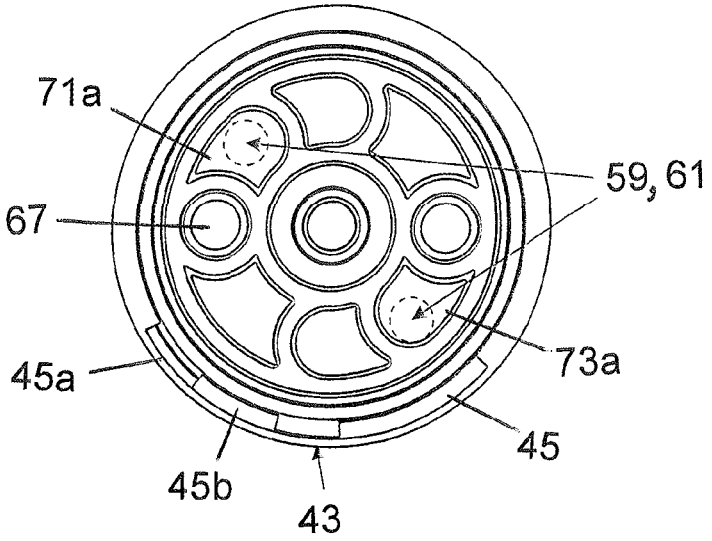
FIG. 6 is a horizontal section showing the manifold base and tap body in the isolated position.

If required, the tap body 3 can be detached from the manifold base 5 by rotating the tap body 3 relative to the manifold base 5 to align the first section 45*a* of the groove 45 with the lug 43 on the manifold base 5 whereupon the tap body 3 can be lifted off the manifold base 5. As the tap body 3 is rotated, the isolator plate 49 and isolator plate seal 51 rotate with the tap body 3 so that communication between the outlet ports 67, 69 of the isolator plate 49 and the inlet ports 59, 61 on the mounting base 5 is gradually reduced. After rotation of approximately 45 degrees from the normal operating position, the isolator plate seal 51 provides a fluid tight seal that isolates the outlet ports 67, 69 from the inlet ports 59, 61 as shown in FIGS. 3 and 6 to prevent flow of water from the manifold base 5 to the tap body 3. In this position, the tap body 3 is still retained on the manifold base 5 by engagement of the lug 43 in the second section 45*b* of the groove 45 and the inlet ports 59, 61 open to sealed areas 71*a*, 73*a* between the manifold base 5 and the isolator plate 49.

Figure 4:
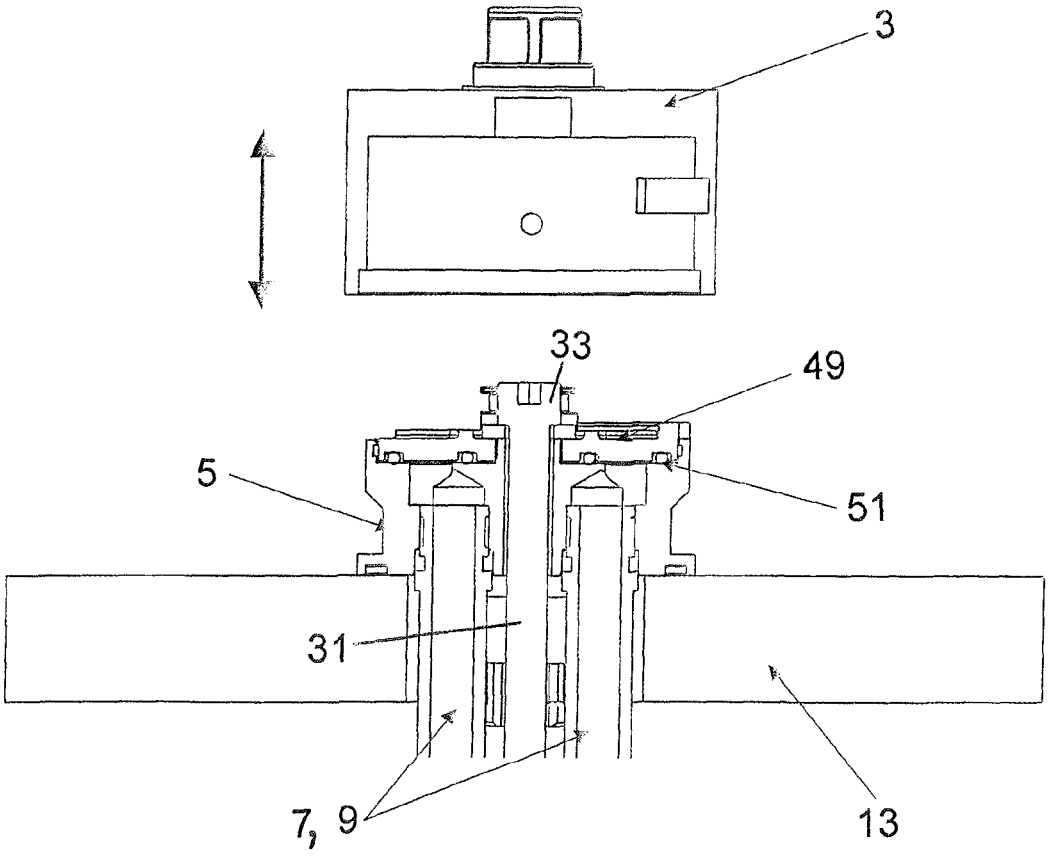
FIG. 4 is a vertical section showing the tap body detached from the manifold base.
Figure 5:
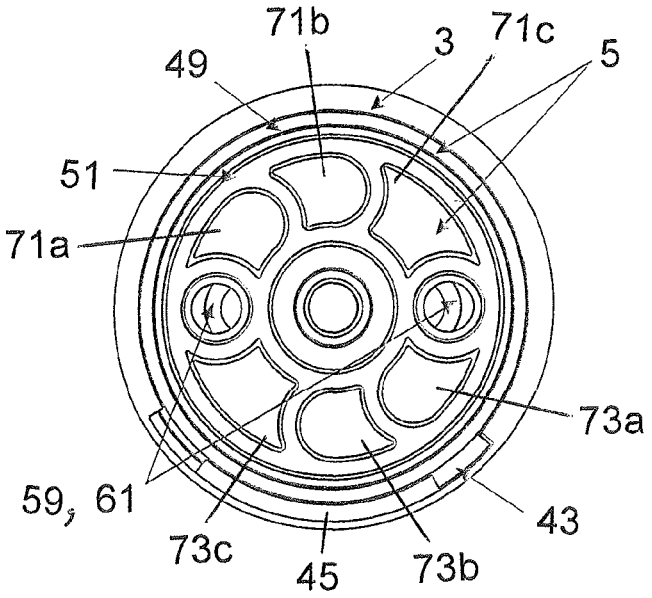
FIG. 5 is a horizontal section showing the manifold base and tap body in the normal operating position.
Figure 7:
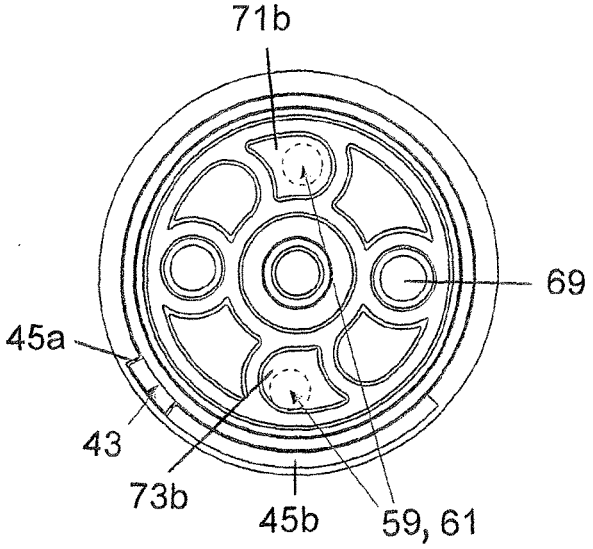
FIG. 7 is a horizontal section showing the manifold base and tap body in the tap release position.

On continued rotation of the tap body 3 in the same direction, the lug 43 is aligned with the first section 45*a* of the groove 45. In this position, the inlet ports 59, 61 open to sealed areas 71*b*, 73*b* between the manifold base 5 and isolator plate 49 as shown in FIG. 7 so that, when the tap body 3 is lifted off the manifold base 5 as shown in FIG. 4, the isolator valve assembly is closed and prevents flow of water from the manifold base 5. Confining the incoming supplies to the sealed areas between the outlet ports 67, 69 when the isolator valve assembly is closed reduces the force of the inlet water pressure pushing the isolator plate 49 away from the manifold base 5 thereby reducing the risk of leakage between the isolator plate 49 and manifold base 5.

The tap body 3 can be re-fitted by a reverse of the above procedure to remove the tap body 3 and the isolator valve assembly is opened and allows flow of water from the manifold base 5 to the tap body 3 as the tap body 3 is rotated relative to the manifold base 5.

As will be appreciated, the clamping assembly is operated from the topside of the mounting surface and the isolator valve assembly is operated as the tap body is attached to and detached from the manifold base. This has a number of advantages including but not limited to

- Access to the underside of the mounting surface to disconnect/reconnect the inlet water supplies and/or to unfasten/fasten the tap assembly may not be required
- The water supply to the tap assembly may not be required in order to service/replace the tap body.
- Separate isolators on the hot and cold inlets may not be required.
- Access to and operation of isolators in awkward places may not be required
- Removal of the tap body without isolating the inlet supplies may be avoided
- Additional tools or effort to isolate the water supplies may be avoided.
- Access to the serviceable items may be facilitated
- Access to filters for cleaning/replacement may be facilitated.

Figure 11:
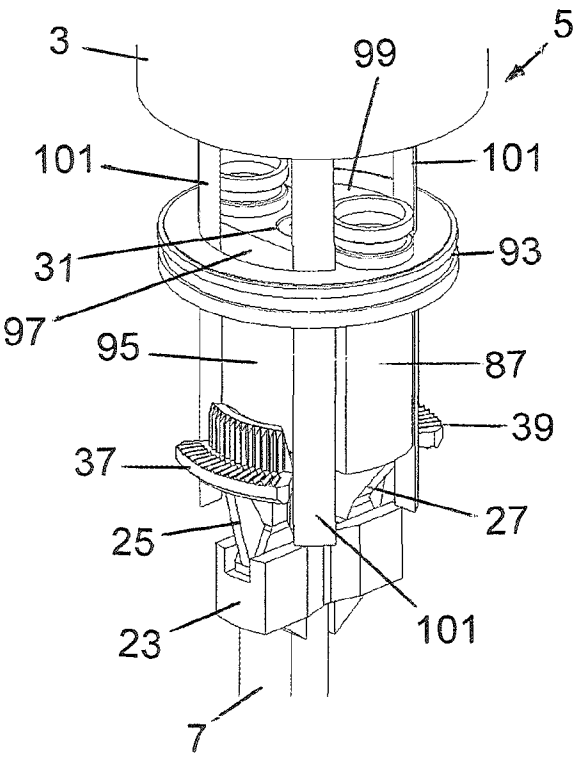
FIG. 11 is a perspective view of a tap assembly according to a third embodiment of the invention partially assembled.
Figure 10:
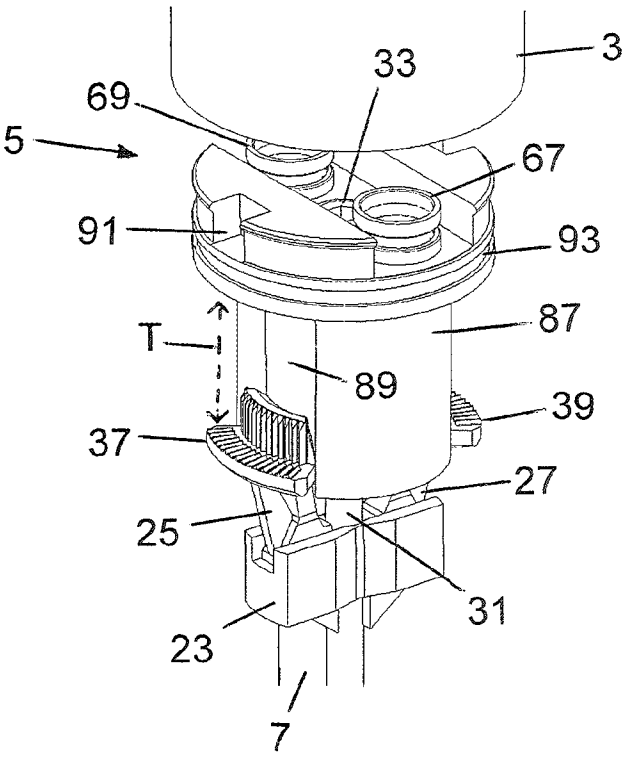
FIG. 10 is a perspective view of a tap assembly according to a second embodiment of the invention partially assembled.

It will be appreciated that the clamping assembly may be employed without the isolator valve and two arrangements in which the isolator valve has been omitted are shown in FIGS. 10 and 11. For convenience, like reference numerals are used to indicate similar features.

In FIG. 10, the manifold base 5 has an integral sleeve 87 that extends within the aperture in the mounting surface (not shown) and is provided with opposed axially extending slots 89 (only one shown) in the outer surface in which the angle section formations 37, 39 of the clamping arms 25, 27 are received. The slots 89 provide a keyway for sliding movement of the angle section formations 37, 39 in an axial direction while preventing relative rotation between the clamping arms 25, 27 and the manifold base 5.

In use, the angle section formations 37, 39 slide upwards in the slots 89 to engage the underside of the mounting surface when the bolt 31 is rotated to fasten the clamping assembly as described previously. When the angle section formations 37, 39 engage the underside of the mounting surface, further rotation of the bolt 31 causes the arms to slide outwards to engage the inner wall of the aperture as described previously and take up any slack so that the manifold base 5 is firmly located on the mounting surface. In this way, variations in the thickness (T) of the mounting surface can be accommodated.

Once the manifold base 5 has been secured, the tap body 3 is located on the manifold base 5 to prevent relative rotation and is axially secured to the manifold base 5 by any suitable means. For example, the tap body 3 may have one or more axial lugs (not shown) on the inner surface that locate in a corresponding recess 91 (only one shown) in the manifold base 5 to prevent relative rotation and may be axially secured by engagement of a grub screw (not shown) in an annular groove 93 in the manifold base 5.

In FIG. 11, the manifold base 5 has an integral sleeve 87 that extends within the aperture in the mounting surface (not shown) and is provided with opposed axially extending flats 95 (one only shown) in the outer surface and a pair of slots 97, 99 providing access to the flats 95 from above the manifold base 5. The slots 97, 99 provide openings for four legs 101 (only three shown) that extend from the tap body 3.

In use, the manifold base 5 is secured to the mounting surface (not shown) by rotating the bolt 31 to fasten the clamping assembly as described previously. The tap body 3 is then lowered onto the manifold base 5 so that the legs 101 pass through the slot 97, 99 and extend either side of the angle section formations 37, 39 to prevent rotation of the tap body 3 relative to the manifold base 5. The tap body 3 may be axially secured to the manifold base 5 by engagement of a grub screw (not shown) in an annular groove 93 in the manifold base 5.

As will be appreciated, restricting rotation of the tap body 3 as described and shown in FIGS. 10 and 11 provides a secure fixing for the tap body 3. With this arrangement, the manifold base 5 has to be correctly positioned on the mounting surface as angular adjustment of the tap body 3 on the manifold base 5 to orientate the tap body 3 in the required direction is not permitted. However, it will be apparent that any adjustment to the mounted position of the tap body 3 can be achieved by detaching the tap body and releasing the clamping assembly sufficiently to rotate the manifold base to the correct position before re-tightening the manifold base 5 and attaching the tap body 3.

It will be understood that the invention is not limited to the previously described embodiments which are capable of being modified without departing from the principles of the invention. For example, in the above embodiments, both clamping arms are pivotal between the collapsed position for passage through the aperture in the mounting surface to the operative position during installation. In a modification, one of the clamping arms may be pivotal between the collapsed position and the operative position and the other arm may be fixed for example, where sufficient clearance to pass through the aperture can be achieved. with one arm fixed and the other arm pivotal. Although in the above-described embodiments the clamping assembly is provided with two clamping arms, it will be understood that more than two clamping arms may be employed according to requirements. Where more than two clamping arms are provided, all the clamping arms may be pivotal between the collapsed position and the operative position or a combination of fixed and pivotal clamping arms may be employed. In the above-described embodiment, the fluid delivery device has a manifold and separate tap body attached to the manifold that allows the tap body to be attached to and removed from the manifold with the manifold secured to the mounting surface. It will be understood that this may not be essential and that the clamping assembly could be attached to the tap body to secure the tap body directly to the mounting surface without a separate manifold.

It will also be understood that the invention is capable of wider application. For example, in the previously described embodiment the tap assembly enables the user to select and discharge water having any temperature from full hot to full cold. However, the invention could easily be adapted for a tap which delivers only hot or cold water. This could be done by simply adding a sealing bung into the unwanted inlet port of the manifold base or by replacing the manifold base with one having only one inlet port. The invention could also be used for mounting other fluid delivery devices such as mixer valves for showers.

It will also be understood that the clamping assembly and isolator valve assembly may be provided together as shown and described in FIGS. 1 to 9. Alternatively, the clamping assembly may be provided separate from the isolator valve assembly as shown and described in FIGS. 10 and 11. Alternatively, the isolator valve assembly may be provided separate from the clamping assembly. The invention includes all such applications.

The invention claimed is:

1. A fluid delivery device comprising:

a mounting element for connection to a fluid supply; and a body element mounted on the mounting element for controlling discharge of fluid from the device, the body element being detachable from the mounting element without disconnecting the mounting element from the fluid supply;

the mounting element including an isolator valve assembly having an open position to connect the fluid supply to the body element when the body element is mounted on the mounting element and a closed position to isolate the fluid supply when the body element is removed from the mounting element, wherein the isolator valve assembly moves between the open and closed positions as the body element is attached to and detached from the mounting element, wherein the isolator valve assembly includes an isolator plate and an isolator plate seal, wherein inlet ports in the mounting element connect to a region between inner and outer rings of the isolator plate seal that prevent the fluid from leaking between the mounting element and the isolator plate at inner and outer peripheries.

2. The fluid delivery device of claim 1, wherein the body element is a push fit on the mounting element and is secured by rotating the body element relative to the mounting element.

3. The fluid delivery device of claim 2, wherein the body element is rotatable between a release position that allows the body element to be pushed on and lifted off the mounting element and a retained position that prevents the body element being lifted off the mounting element.

4. The fluid delivery device of claim 3, wherein the isolator valve assembly is opened and closed according to a direction of rotation of the body element at a position between the release position and retained position.

5. The fluid delivery device of claim 2, wherein the isolator valve assembly moves between the open and closed positions in response to axial movement of the body element relative to the mounting element.

6. The fluid delivery device of claim 1, wherein the body element is releasably attached to the mounting element by interengageable formations.

7. The fluid delivery device of claim 6, wherein the interengageable formations are engaged and disengaged by axial and rotational movement of the body element relative to the mounting element.

8. The fluid delivery device of claim 6, wherein the interengageable formations comprise a bayonet connection.

9. The fluid delivery device of claim 1, wherein the isolator plate is mounted for rotation relative to the mounting element between end positions defined by engagement of a lug on an edge of the isolator plate with opposite ends of a slot in a sidewall of the mounting element.

10. The fluid delivery device of claim 1, wherein the isolator plate seal seals between an underside of the isolator plate and the mounting element and is located in a channel in the underside of the isolator plate so as to rotate with the isolator plate.

11. The fluid delivery device of claim 1, wherein the inner and outer rings are joined together by a plurality of connecting webs that seal around outlet ports in the isolator plate and divide a region between the outlet ports into three areas on one side of the outlet ports and three areas on an opposite side of the outlet ports.

12. The fluid delivery device of claim 11, wherein the outlet ports extend above the isolator plate and are received in a pair of inlet ports in the body element when the body element is lowered onto the mounting element so that the isolator plate rotates with the body element.

13. The fluid delivery device of claim 12, wherein the outlet ports are provided with seals received in annular grooves to provide a fluid tight seal with the inlet ports in the body element.

14. The fluid delivery device of claim 12, wherein the inlet ports in the body element are provided with removable filters that are retained in position by the outlet ports of the mounting element when the body element is lowered onto the mounting element.

15. The fluid delivery device of claim 1, wherein the isolator valve assembly controls the fluid from the mounting element to the body element such that, when the body element is connected to the mounting element in a normal operating position, outlet ports of the isolator plate are connected to inlet ports in the body element and communicate with inlet ports in the mounting element so that the fluid can flow freely from the mounting element to the body element.

16. The fluid delivery device of claim 15, wherein the isolator plate and isolator plate seal are rotatable with the body element and the isolator plate seal provides a fluid tight seal that isolates the outlet ports of the isolator plate from inlet ports in the mounting element to prevent flow of the fluid from the mounting element to the body element as the body element is rotated from the normal operating position.

17. The fluid delivery device of claim 16, wherein the inlet ports of the mounting element open to sealed areas between the mounting element and isolator plate so that, when the body element is lifted off the mounting element, the isolator valve assembly is closed and prevents flow of the fluid from the mounting element.

18. The fluid delivery device of claim 17, wherein the isolator valve assembly is opened and allows flow of the fluid from the mounting element to the body element as the body element is rotated relative to the mounting element to attach the body element to the mounting element.

* * * * *